US008485569B2

(12) United States Patent
Dynes et al.

(10) Patent No.: US 8,485,569 B2
(45) Date of Patent: Jul. 16, 2013

(54) LOCK ASSEMBLY

(75) Inventors: Nicholas John Dynes, Margate (GB); Simon William Guy, Rainham (GB)

(73) Assignee: Adams Rite Europe Limited, Kent (GB)

( * ) Notice: Subject to any disclaimer, the term of this patent is extended or adjusted under 35 U.S.C. 154(b) by 165 days.

(21) Appl. No.: 12/522,143

(22) PCT Filed: Jan. 4, 2008

(86) PCT No.: PCT/GB2008/000021

§ 371 (c)(1),
(2), (4) Date: Jun. 28, 2010

(87) PCT Pub. No.: WO2008/081192

PCT Pub. Date: Jul. 10, 2008

(65) Prior Publication Data

US 2011/0037278 A1 Feb. 17, 2011

(30) Foreign Application Priority Data

Jan. 5, 2007 (GB) ..... 0700202.5

(51) Int. Cl.
*E05C 3/00* (2006.01)
*E05B 63/14* (2006.01)

(52) U.S. Cl.
USPC ..... 292/194; 70/108

(58) Field of Classification Search
CPC ..... E05C 3/042; E05B 59/00
USPC ..... 292/194, 195, 196, 201, 200, 5, 7, 292/197, 224, 226; 70/108, 109, 110, 111
See application file for complete search history.

(56) References Cited

U.S. PATENT DOCUMENTS 3,892,110 A * 7/1975 Poli ..... 70/107
3,899,906 A * 8/1975 Bradstock ..... 70/139

(Continued)

FOREIGN PATENT DOCUMENTS

AU B-60719/86 2/1987
DE 530612 C 7/1931

(Continued)

OTHER PUBLICATIONS

PCT International Search Report dated Jun. 27, 2008 in International Application No. PCT/GB2008/000025.

(Continued)

*Primary Examiner* — Kristina Fulton
*Assistant Examiner* — Nathan Cumar
(74) *Attorney, Agent, or Firm* — Stout, Uxa, Buyan & Mullins; Carlos A. Fisher

(57) ABSTRACT

A lock assembly (1) comprises a rotary latch member (3) rotatable between a first, locking, position and a second, released, position, an actuator (23) for effecting rotation of the rotary latch member, and a rotary-drive mechanism between the actuator (23) and the rotary latch member (3) for transmitting a rotary drive to the rotary latch member. The rotary drive mechanism includes first and second members (3, 5) mounted for rotation about substantially parallel axes and having overlapping peripheral portions with sets of interengaging formations (19A, 20A and 19B, 20B), each set of interengaging formations comprising a recess (19A, 19B) extending radially inwardly from a peripheral portion of one of the first and second members and a post (20A, 20B) projecting in a direction generally parallel to the axes of rotation of the members and engagable in the recess. A first set of interengaging formations is arranged to interengage over a first part of the movement of the rotary latch member (3) from the first, locking, position to the second, released, position and a second set of interengaging formations is arranged to interengage over a second part of the movement of the rotary latch member (3) from the first, locking, position to the second, released, position. The first and second parts of the movement of the rotary latch member (3) are different from one another and continuous or overlapping.

22 Claims, 4 Drawing Sheets

U.S. PATENT DOCUMENTS

Figure 1:
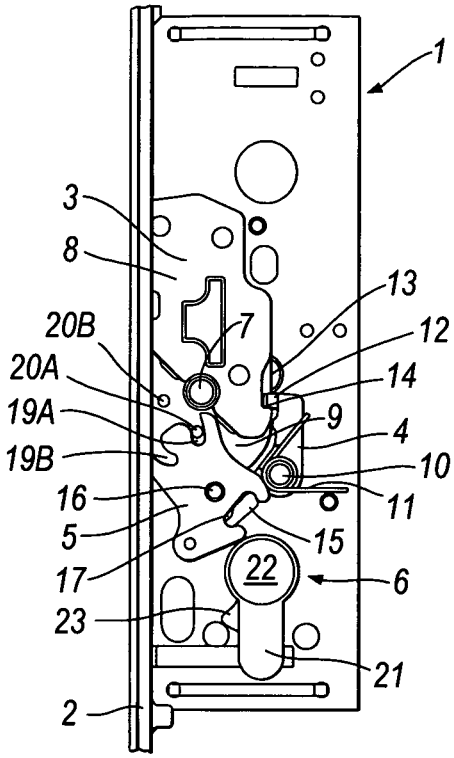

| | | | | | |
|---|---|---|---|---|---|
| 3,917,330 | A | | 11/1975 | Quantz | |
| 4,118,056 | A | * | 10/1978 | Alexander | 292/169.17 |
| 4,218,903 | A | * | 8/1980 | Eads | 70/107 |
| 4,387,918 | A | * | 6/1983 | Dunphy et al. | 292/224 |
| 4,583,382 | A | * | 4/1986 | Hull | 70/107 |
| 4,663,950 | A | | 5/1987 | Mascotte | |
| 4,881,766 | A | * | 11/1989 | Schmidt et al. | 292/201 |
| 5,452,927 | A | | 9/1995 | Uyeda | |
| 5,495,731 | A | * | 3/1996 | Riznik | 70/108 |
| 5,678,870 | A | * | 10/1997 | Pelletier | 292/244 |
| 6,302,455 | B1 | | 10/2001 | Huang | |
| 6,393,878 | B1 | * | 5/2002 | Fayngersh et al. | 70/107 |

FOREIGN PATENT DOCUMENTS

| | | | |
|---|---|---|---|
| DE | 2409824 | A1 | 9/1975 |
| DE | 9411842 | U1 | 11/1994 |
| EP | 0004849 | A1 | 10/1979 |
| EP | 0579003 | A1 | 1/1994 |
| EP | 1239105 | A1 | 9/2002 |
| EP | 1357245 | A2 | 10/2003 |
| EP | 1522661 | A2 | 4/2005 |
| EP | 1522661 | A3 | 4/2005 |
| FR | 2540170 | A1 | 8/1984 |
| FR | 2697566 | A1 | 5/1994 |
| FR | 2772816 | A1 | 6/1999 |
| GB | 734722 | A | 8/1955 |
| GB | 1489314 | | 10/1977 |
| GB | 2274134 | A | 7/1994 |
| GB | 2309996 | A | 8/1997 |
| GB | 2400627 | A | 10/2004 |
| JP | 2003035059 | A | 2/2003 |
| SE | 0332945 | B | 2/1971 |
| WO | WO 97/33060 | A1 | 9/1997 |

OTHER PUBLICATIONS

PCT International Search Report dated May 28, 2008 in International Application No. PCT/GB2008/000021.

UK Search Report dated Feb. 17, 2008 in Application No. GB0700201.7.

UK Search Report dated Feb. 14, 2008 in Application No. GB0700202.5.

* cited by examiner

LOCK ASSEMBLY

This invention relates to a lock assembly and to a method of operating a lock assembly. The invention relates particularly to lock assemblies including a swing bolt or rotary latch member.

Swing bolt mechanisms for doors, commonly aluminium doors, are well known. In a typical arrangement a key is inserted into the plug of a cylinder assembly, for example a Euro profile cylinder assembly, and turning of the key is effective to move the swing bolt between a first locking position and a second released position. The swing bolt is generally required to be robust and therefore has significant mass. Often an angular rotation of the order of 90 degrees is required to move the swing bolt between a locked position and a retracted or released position. That large movement is required to be achieved as a result of turning a key that may be relatively small. It therefore becomes difficult to provide a lock assembly in which movement of the swing bolt can be achieved relatively easily by turning of a key over the entire range of movement of the swing bolt.

It is an object of the invention to provide a lock assembly in which movement of an actuator to effect movement of a swing bolt across its entire range of movement can be accomplished relatively easily.

According to the invention there is provided a lock assembly comprising a rotary latch member rotatable between a first, locking, position and a second, released, position, an actuator for effecting rotation of the rotary latch member, and a rotary drive mechanism between the actuator and the rotary latch member for transmitting a rotary drive to the rotary latch member, the rotary drive mechanism including first and second members mounted for rotation about substantially parallel axes and having overlapping peripheral portions with sets of interengaging formations, each set of interengaging formations comprising a recess extending radially inwardly from a peripheral portion of one of the first and second members and a post projecting in a direction generally parallel to the axes of rotation of the members and engagable in the recess, a first set of interengaging formations being arranged to interengage over a first part of the movement of the rotary latch member from the first, locking, position to the second, released, position and a second set of interengaging formations being arranged to interengage over a second part of the movement of the rotary latch member from the first, locking, position to the second, released, position, the first and second parts of the movement of the rotary latch member being different from one another and continuous or overlapping.

By providing more than one set of interengaging formations and transmitting the drive through different sets at different stages of the movement of the rotary latch member or swing bolt, it becomes possible to have a drive transmission with a more constant gearing ratio, enabling the peak force required to be applied to the actuator throughout its range of movement to be reduced.

Where reference is made in this specification to a "member", it should be understood that the "member" need not necessarily be formed of a single piece, but may be formed of several pieces fixed together to operate as a single unit.

The second member is preferably the rotary latch member and the first member may be driven directly by the actuator. Such an arrangement reduces the number of moving parts that are required in the lock assembly. The posts are preferably provided on the rotary latch member with the recesses on the other member but the converse is possible and it is also possible to have a post and a recess on each member.

The first member is preferably a rotatable drive member arranged to be rotated by the actuator. In an embodiment of the invention described below the rotatable drive member is in the form of a plate.

The actuator is preferably a rotary drive element arranged to be rotated by a key. More preferably, the rotary drive element is part of a cylinder assembly, for example a Euro profile cylinder assembly, for receiving a key.

The lock assembly preferably further includes a deadlocking member for deadlocking the rotary latch member and movable between a first, deadlocking, position and a second, released, position. The deadlocking member is preferably rotatable between the first, deadlocking, position and the second, released, position. The deadlocking member is preferably resiliently biased, preferably by a torsion spring, into the first, deadlocking, position.

Preferably the actuator directly engages the deadlocking member. This again reduces the number of moving parts that are required in the lock assembly.

Preferably the assembly is arranged such that upon initial rotation of the actuator to move the rotary latch member from the first, locking, position to the second, released, position, the deadlocking member is driven by direct engagement of the actuator from the first, deadlocking, position to the second, released, position. By providing for direct engagement of the rotary drive element with the deadlocking member, the mechanism can be simplified, improving reliability but at the same time saving cost, compared to an arrangement in which the one or more further drive elements are present in the drive path between the deadlocking member and the rotary drive element.

It is also preferred that the deadlocking member locks the rotary latch member in the second, released, position. Thus, it is preferred that upon further rotation of the rotary drive element from the first position towards the second position, the rotary latch member is rotated to the second, released, position and, upon still further rotation of the rotary drive element from the first position towards the second position, the deadlocking member moves to the first, deadlocking, position in which the rotary latch member is prevented by the engagement of the deadlocking member from returning to the first position. It will be noted that the deadlocking member is referred to as adopting the "first, deadlocking, position" when locking the rotary latch member in both the first, locking, position and the second, released, position. As will be understood, this "first position" of the deadlocking member may not be identical in the two cases; for example, the deadlocking member might be in a slightly different end position when locking the rotary latch member in the second, released, position than it is when locking the rotary latch member in the first, locking, position, but those two positions would both be more similar to each other than the second, released, position of the deadlocking member.

To avoid unnecessary complexity and extra parts, it is preferred that the deadlocking member directly engages the rotary latch member.

The deadlocking member preferably has a formation for engaging the rotary latch member, the formation being closer to the axis of rotation of the rotary latch member when the deadlocking member is in the first, deadlocking, position than when it is in the second, released, position. The formation preferably comprises a projection projecting towards the axis of rotation of the rotary latch member. The projection preferably engages against respective shoulders formed on the rotary latch member in the first and second positions of the rotary latch member. Each shoulder may form part of a recess in the periphery of the rotary latch member.

The actuator preferably cammingly engages the deadlocking member. The actuator may slide over a surface of the deadlocking member during the camming engagement.

The engagement of the deadlocking member with the rotary latch member and the engagement of the deadlocking member with the actuator are preferably on opposite sides of the axis of rotation of the deadlocking member. Such an arrangement enables efficient deadlocking to be obtained in a simple and compact manner.

Preferably, the recesses include walls that are engaged by the posts to transmit movement from the actuator to the rotary latch member, the walls being of a non-planar shape. Preferably, the walls are irregularly curved. The curvature of the walls is preferably chosen to reduce or substantially eliminate the variation in the gearing ratio during at least a major part of the range of movement.

Each recess is preferably so deep that the post is always spaced from the bottom of the recess during use. This provides a space in which dust/dirt can accumulate until it eventually reaches a depth at which it is cleared out by contact with the post.

According to the first aspect of the invention, there is also provided a method of operating a lock assembly comprising the following steps:

providing a rotary latch member, a rotary drive mechanism and an actuator for effecting rotation of the rotary latch member via the rotary drive mechanism, the rotary drive mechanism including first and second members mounted for rotation about substantially parallel axes and having overlapping peripheral portions with sets of interengaging formations, each set of interengaging formations comprising a recess extending radially inwardly from a peripheral portion of one of the first and second members and a post projecting in a direction generally parallel to the axes of rotation of the members and engagable in the recess, and operating the actuator to rotate the rotary latch member from a first position in which the rotary latch member is in a first, locking, position to a second position in which the rotary latch member is in a second, released, position, wherein upon initial operation of the actuator to move the rotary latch member, a first set of interengaging formations interengage to effect rotation of the rotary latch member and upon further operation of the actuator a second set of interengaging formations interengage to effect rotation of the rotary latch member and the first set of interengaging formations disengage.

The method may also have any other features corresponding to the features of the lock assembly described above.

Figure 6:
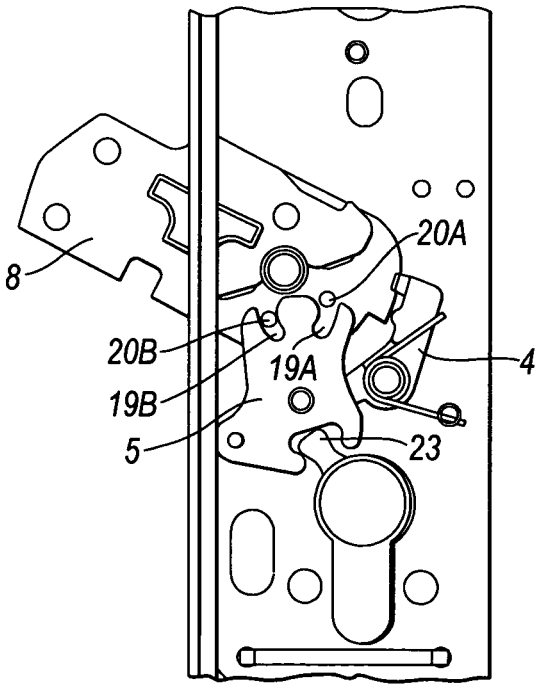
Figure 7:
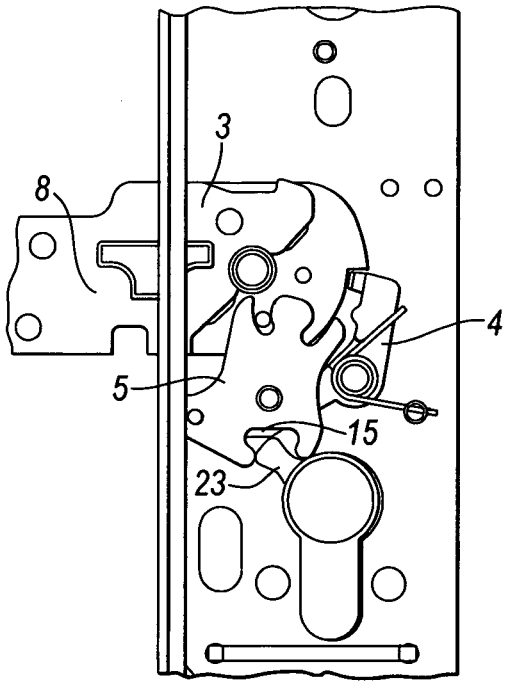
Figure 8:
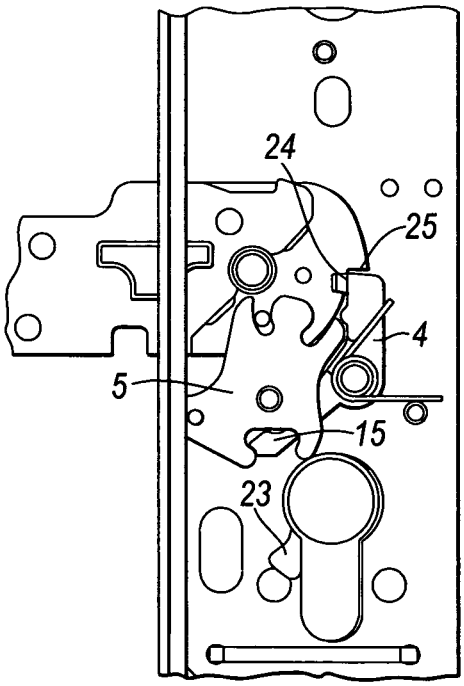

By way of example, an embodiment of the invention will now be described with reference to the accompanying drawings, in which:

FIG. 1 is a schematic side view of a lock assembly mounted in a door, the lock assembly being shown in a fully unlocked condition; and FIGS. 2 to 8 show movements of parts of the lock assembly as a key is turned to move the parts progressively from the positions shown in FIG. 1, through each of the positions shown in FIGS. 2 to 7 in turn, and finally into a fully locked condition shown in FIG. 8.

Referring first to FIG. 1, there is shown a lock assembly 1 mounted as a mortise lock in an edge of an aluminium door frame 2. The lock assembly 1 generally comprises a swing bolt or rotary latch member 3, a deadlocking member 4, a drive plate 5 and a lock cylinder assembly 6.

The rotary latch member 3 is rotatably mounted on a shaft 7 and in the position shown in FIG. 1 is contained wholly within the door frame. Thus the latch member 3 is in an unlocked or released position. The rotary latch member is formed of a plurality of parts fixed together and in combination they define a bolt portion 8 and a body portion 9.

The deadlocking member 4 is rotatably mounted on a shaft 10 and is biased in an anticlockwise direction, as seen in the drawings, by a torsion spring 11. At an upper end of the deadlocking member 4, above the shaft 10, there is a projecting nose 12 which, in the position shown in FIG. 1, projects into a recess 13 of the latch member 3 and engages a shoulder 14 thereon. At a lower end of the deadlocking member 4, below the shaft 10, there is a trailing portion 15 of the deadlocking member and that trailing portion has a bottom surface that defines a cam follower surface, as will be described more fully below.

The drive plate 5 is rotatably mounted on a shaft 16. The drive plate 5 is provided in a lower peripheral region with a recess 17 and in an upper peripheral region with a pair of recesses 19A and 19B. The rotary latch member 3 is provided with a pair of posts 20A and 20B which project from the latch member in a direction parallel to the axes of rotation of the latch member and the drive plate. In FIG. 1 the post 20A is shown engaging in the recess 19A, whilst the post 20B is not engaging in the recess 19B.

The lock cylinder assembly 6 is a standard Euro profile cylinder assembly, including a cylinder 21 and a plug 22 rotatably mounted in the cylinder and including a keyway (not shown). Tumbler and driver pins in passageways formed in the plug and cylinder prevent rotation of the plug 22 unless the correct key is inserted, whereupon the plug 22 can be rotated relative to the cylinder. The plug carries a rotary drive element or cam 23 which, as will be described below, is an actuator for operating the lock assembly.

In the position shown in FIG. 1, the cam 23 is at approximately 7 o'clock on a clock face and does not therefore interact with other parts of the lock mechanism. The rotary latch member 3 is in its retracted, released or unlocked, position and the deadlocking member 4 is spring biased by the torsion spring 11 into engagement with the rotary latch member 3, with the nose 12 of the deadlocking member engaging the shoulder 14 on the latch member 3 and therefore preventing the latch member from moving away from the retracted, released, position.

Figure 2:
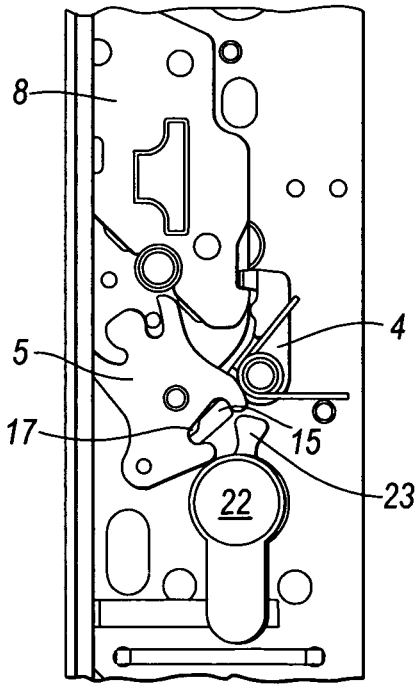

When a user inserts the correct key into the plug 22, it is then possible to rotate the plug anticlockwise, as seen in the drawings, and FIG. 2 shows the assembly after some rotation; it will be seen that the cam 23 has been rotated to about 1 o'clock and is just about to enter the recess 17 in the drive plate 5 and come into contact with the trailing portion 15 of the deadlocking member 4. At this stage it is only the cam 23 and the plug 22 that have moved from the position shown in FIG. 1.

Figure 3:
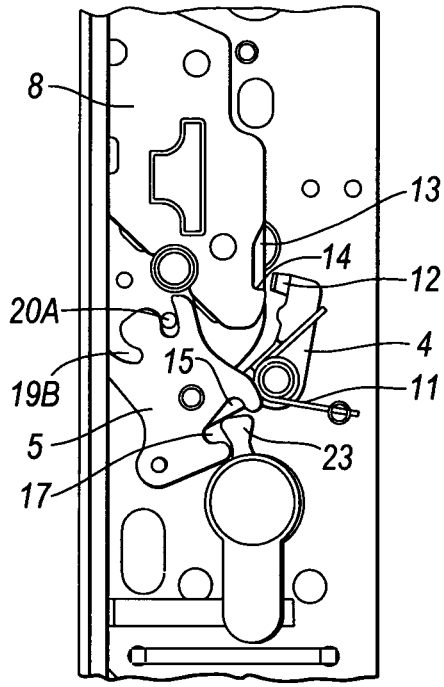

Upon further rotation of the cam 23 to the position shown in FIG. 3, the cam 23 enters the recess 17 and, as it does so, bears against the trailing portion 15 of the deadlocking member 4, cammingly engaging the member 4 and causing it to rotate clockwise, as seen in FIG. 3, against the bias of the torsion spring 11 so that the nose 12 on the deadlocking member moves out of the recess 13 in the latch member. In this position the rotary latch member 3 is now free to rotate.

Figure 4:
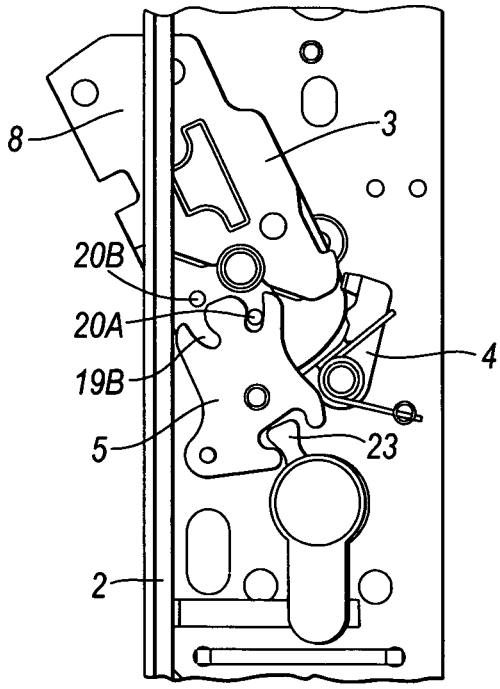

Upon further rotation of the cam 23 to the position shown in FIG. 4, with the cam at about 11 o'clock, the cam 23 engages the drive plate 5 rotating the drive plate clockwise, as seen in FIG. 4. That clockwise rotation of the drive plate 5 causes, via the engagement of the post 20A in the recess 19A, anticlockwise rotation of the rotary latch member 3 which, as can be seen from FIG. 4 begins to project out of the door frame 2.

Figure 5:
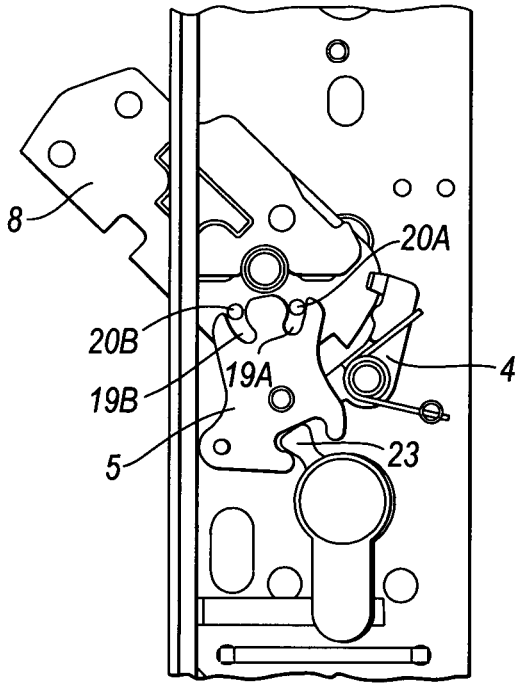

Upon further rotation of the cam 23 to the position shown in FIG. 5, the post 20B on the rotary latch member 3 begins to enter the recess 19B on the drive plate 5 while at the same time the post 20A begins to leave the recess 19A. As can be seen from FIG. 5, there is a short transitional period during which both the posts are in both the recesses.

Upon further rotation of the cam 23 to the position shown in FIG. 6, the post 20A exits from the recess 19A and therefore the drive from the drive plate 5 to the rotary latch member 3 is transmitted entirely by the post 20B engaging the wall of the recess 19B.

Upon still further rotation of the cam 23 to the position shown in FIG. 7, the rotary latch member 3 is rotated into a fully extended locking position. At this position, with the cam 23 at about 10 o'clock, the cam 23 still bears against the trailing portion 15 of the deadlocking member 4 to prevent the deadlocking member moving into its locking position.

The cam 23 is then rotated to the position shown in FIG. 8, which was also its starting position. During that rotation it moves away from the trailing portion 15 of the deadlocking member 4 causing the deadlocking member to rotate anticlockwise, as seen in FIG. 8, under the bias of the torsion spring 11. The nose 12 of the deadlocking member 4 then moves into a recess 24 in the rotary latch member 3 and engagement of the deadlocking member 4 with the rotary latch member prevents the rotary latch member rotating out of its locked position.

As will be understood, the rotary latch member 3 is moved back to its released position by rotating the cam 23 clockwise, as seen in the drawings, causing all the actions described above to be reversed. Thus the parts move in turn through the positions shown starting from FIG. 8 and working backwards to FIG. 1.

It will be noted that the recesses 19A and 19B are bounded by irregularly curved walls. Those walls are shaped so as to provide the most advantageous gearing ratio throughout the range of movement of the drive plate 5 and the rotary latch member 3. Generally it will be desirable to have a constant gearing ratio between the angular movement of the cam 23 and the angular movement of the rotary latch member 3. That should make the operation of the lock assembly especially smooth. By providing two sets of interengaging formations (posts 20A and 20B and recesses 19A and 19B) we have found that a smooth action can be obtained. Also, it should be noted that the posts 20A and 20B never reach the deepest parts of the recesses 19A and 19B. By providing the extra length to each slot the removal of any dust/dirt that might otherwise adversely affect operation of the mechanism is facilitated. The dust/dirt may build up in the deepest part of each of the slots until it is eventually pushed out of the slot by the action of the post. In that way a self-cleaning of the mechanism is achieved. It is possible, if desired, to have one or more further sets of interengaging formations.

The lock assembly described above is of a simple construction having few moving parts. The direct engagement of the deadlocking member 4 with the cam 23 is especially advantageous in this respect. Consequently the lock is reliable, yet simple and economical to manufacture.

The invention claimed is:

1. A lock assembly comprising a) a rotary latch member rotatable between a first, locking, position and a second, released, position;

b) an actuator for effecting rotation of the rotary latch member;

c) a deadlocking member movable between a first, deadlocking, position and a second, released, position for deadlocking the rotary latch member, wherein the actuator directly engages the deadlocking member; and d) a rotary drive mechanism between the actuator and the rotary latch member for transmitting a rotary drive to the rotary latch member, the rotary drive mechanism including first and second members, said first member mounted for rotation about a first axis, and said second member mounted for rotation about a second, axis, substantially parallel to the first axis, and having overlapping peripheral portions with at least two sets of interengaging formations, each set of interengaging formations comprising:

i) a recess extending radially outwardly from a peripheral portion of one of the first and second members, and ii) a post projecting in the direction generally parallel to the axes of rotation of the members and engagable in said recess, a first set of interengaging formations being arranged to interengage over a first part of the movement of the rotary latch member from the first, locking, position to the second, released, position and a second set of interengaging formations being arranged to interengage over a second part of the movement of the rotary latch member from the first, locking, position to the second, released, position, the first and second parts of the movement of the rotary latch member being different from one another and continuous or overlapping, and wherein said deadlocking member is mounted for rotation about a third axis and is distinct from the rotary drive mechanism.

2. A lock assembly according to claim 1, in which the second member is the rotary latch member.

3. A lock assembly according to claim 1, in which the first member is a rotatable drive member arranged to be rotated by the actuator.

4. A lock assembly according to claim 1, in which the actuator is a rotary drive element arranged to be rotated by key.

5. A lock assembly according to claim 4, in which the rotary drive element is part of the cylinder assembly for receiving a key.

6. A lock assembly according to claim 1 in which the deadlocking member is rotatable between the first, deadlocking, position and the second, released, position.

7. A lock assembly according to claim 6, in which the deadlocking member is resiliently biased into the first, deadlocking, position.

8. A lock assembly according to claim 6, in which the assembly is arranged such that upon initial rotation of the actuator to move the rotary latch member from the first, blocking, position to the second, released, position the deadlocking member is driven by direct engagement of the actuator from the first, deadlocking, position to the second, released, position.

9. A lock assembly according to claim 6, in which the actuator directly engages the deadlocking member, and the assembly is arranged such that upon initial rotation of the actuator to move the rotary latch member from the first, blocking, position to the second, released, position the deadlocking member is driven by direct engagement of the actuator from the first, deadlocking, position to the second, released, position, and wherein, upon further rotation of the rotary drive element from the first position towards the second position, the rotary latch member is rotated to the second, released position and, upon still further rotation of the rotary drive element from the first position towards the second position, the deadlocking member moves to the first, deadlocking, position in which the rotary latch member is prevented by the engagement of the deadlocking member from returning to the first position.

10. A lock assembly according to claim 1, in which the deadlocking member directly engages the rotary latch member in its first, deadlocking, position.

11. A lock assembly according to claim 1, in which the deadlocking member has a formation for engaging the rotary latch member, the formation being closer to the axis of rotation of the rotary latch member when the deadlocking member is in the first, deadlocking, position than when it is in the second, released, position.

12. A lock assembly according to claim 11, in which the formation comprises a projection projecting towards the axis of rotation of the rotary latch member.

13. A lock assembly according to claim 12, in which the projection engages against respective shoulders formed on the rotary latch member in the first and second positions of the rotary latch member.

14. A lock assembly according to claim 1, in which the actuator cammingly engages the deadlocking member.

15. A lock assembly according to claim 14, in which the engagement of the deadlocking member with the rotary latch member and the engagement of the deadlocking member with the actuator are on opposite sides of the axis of rotation of the deadlocking member.

16. A lock assembly according to claim 1, in which the recesses include walls that are engaged by the posts to transmit movement from the actuator to the rotary latch member, the walls being of a non-planar shape.

17. A lock assembly according to claim 16, in which the walls are irregularly curved.

18. A method of operating a lock assembly comprising the following steps:

providing a rotary latch member, a rotary drive mechanism, and an actuator for effecting rotation of the rotary latch member via the rotary drive mechanism; the rotary drive mechanism including first and second members, said first member mounted for rotation about a first axis, and said second member mounted for rotation about a second, axis, substantially parallel to the first axis, and having overlapping peripheral portions with at least two sets of interengaging formations, each set of interengaging formations comprising:

a) a recess extending radially inwardly from a peripheral portion of one of the first and second members and b) a post projecting in a direction generally parallel to the axes of rotation of the members and engageable in said recess, and operating the actuator to rotate the rotary latch member from a first position in which the rotary latch member is in the first, locking, position to a second position in which the rotary latch member is in the second, released, position; wherein operating the actuator also directly engages and rotates a deadlocking member from a first, deadlocking, position to a second, released, position, wherein upon initial operation of the actuator to move the rotary latch member, a first set of the interengaging formations interengage to affect rotation of the rotary latch member and upon further operation of the actuator a second set of interengaging formations interengage to affect rotation of the rotary latch member and the first set of interengaging formations disengage, and wherein said deadlocking member is mounted for rotation about a third axis and is distinct from the rotary drive mechanism.

19. A lock assembly comprising a) a rotary latch member rotatable between a first, locking, position and a second, released, position;

b) an actuator for effecting rotation of the rotary latch member;

c) a deadlocking member movable between a first, deadlocking, position and a second, released, position for deadlocking the rotary latch member, wherein the actuator directly engages the deadlocking member; and d) a rotary drive mechanism for transmitting a rotary drive to the rotary latch member, the rotary drive mechanism comprising a rotary drive plate and said rotary latch member, said rotary drive plate mounted for rotation about a first axis, and said rotary latch member mounted for rotation about a second, axis, substantially parallel to the first axis, and having overlapping peripheral portions with at least two sets of interengaging formations, each set of interengaging formations comprising:

i) a recess extending radially outwardly from a peripheral portion of at least one of the rotary drive plate and said rotary latch member, and ii) a post projecting in the direction generally parallel to the axes of rotation of the rotary drive plate and said rotary latch member and engagable in said recess, a first set of interengaging formations being arranged to interengage over a first part of the movement of the rotary latch member from the first, locking, position to the second, released, position and a second set of interengaging formations being arranged to interengage over a second part of the movement of the rotary latch member from the first, locking, position to the second, released, position, the first and second parts of the movement of the rotary latch member being different from one another and continuous or overlapping, and wherein said deadlocking member is mounted for rotation about a third axis and is distinct from the rotary drive mechanism.

20. A lock assembly according to claim 19 in which the deadlocking member is rotatable between the first, deadlocking, position and the second, released, position.

21. A lock assembly according to claim 19, in which the deadlocking member has a formation for engaging the rotary latch member, the formation being closer to the axis of rotation of the rotary latch member when the deadlocking member is in the first, deadlocking, position than when it is in the second, released, position.

22. A lock assembly according to claim 21, in which the formation comprises a projection projecting towards the axis of rotation of the rotary latch member.

* * * * *